United States Patent [19]

Wang

[11] Patent Number: 4,982,798

[45] Date of Patent: Jan. 8, 1991

[54] EXTINGUISHER FOR USE IN AN AUTOMOBILE

[76] Inventor: Hsug-Fang Wang, No. 129, Tuan-Chu Lane, Tuan-Chu Li, Chiayi City, Taiwan

[21] Appl. No.: 379,187

[22] Filed: Jul. 12, 1989

[51] Int. Cl.[5] ..... A62C 3/07

[52] U.S. Cl. ..... 169/62; 169/75; 222/402.11

[58] Field of Search ..... 169/62, 51, 70, 75, 169/89; 222/402.11, 402.14

[56] References Cited

U.S. PATENT DOCUMENTS

| | | | |
|---|---|---|---|
| 1,286,998 | 12/1918 | Graaff | 169/62 |
| 1,297,024 | 3/1919 | Smith | 169/51 |
| 1,464,001 | 8/1923 | Iddings | 169/51 |
| 1,744,733 | 1/1930 | Beames | 169/62 |
| 3,184,116 | 5/1965 | Huling | 222/402.11 |
| 4,037,814 | 7/1977 | Clausen | 169/51 |

FOREIGN PATENT DOCUMENTS

| | | | |
|---|---|---|---|
| 630153 | 11/1927 | France | 169/62 |
| 391166 | 4/1933 | United Kingdom | 169/62 |

*Primary Examiner*—Joseph F. Peters, Jr.
*Assistant Examiner*—Anne E. Bidwell
*Attorney, Agent, or Firm*—Kenyon & Kenyon

[57] ABSTRACT

An extinguisher includes a mounting seat fixed in the driver's cab of an automobile near the driver's seat, an extinguisher body mounted removably on the mounting seat, a resilient element depressing the push-button type switch of the extinguisher body, a hose extending from the driver's cab to the engine compartment in communication with the spray-opening of the extinguisher body, and a nozzle disposed at the end of the hose and directed to the automobile engine. When a safety lock is pulled away from the extinguisher body, the fire-extinguishing substances contained in the extinguisher body spray from the nozzle due to the fact that the switch is depressed by the resilient element.

1 Claim, 5 Drawing Sheets

EXTINGUISHER FOR USE IN AN AUTOMOBILE

BACKGROUND OF THE INVENTION

This invention relates to an extinguisher to be installed in an automobile which is effective for extinguishing fire burning from the engine of the automobile.

In case of traffic accident, the engine of the automobiles involved sometimes catch fire. As a precaution against this kind of dangerous situation, miniature extinguishers are often stored in automobiles. Referring to FIG. 1, such an extinguisher (A) includes a push-button type switch (B), a safety lock (C) and a spray-opening (D). In a situation where the safety lock (C) is not removed from the extinguisher (A), the switch (B) cannot be depressed. In use, referring to FIG. 2, the safety lock (C) is first pulled away from the extinguisher (A) so that the switch (B) can be depressed, thereby spraying the high-pressure gaseous helium in the extinguisher (A) from the opening (D). Normally, the extinguisher (A) is placed in the trunk of an automobile or under the driver's seat of the same. When an automobile is involved in a traffic accident, either the occupants or the extinguisher (A) in the automobile may be stuck inside the automobile as a result of the damage to the body thereof. In a case where the engine of an automobile is on fire due to a traffic accident, if the occupants in the automobile cannot gain access to either the extinguisher (A), or the engine, because the automobile body is damaged, the extinguisher (A) cannot be used to extinguish the fire in the engine.

SUMMARY OF THE INVENTION

It is therefore the main object of this invention to provide an automobile with an extinguisher installed therein which can be controlled by a driver, while sitting In the driver's seat, to extinguish a fire in the automobile engine which results from a traffic accident.

According to this invention, an extinguisher is installed in an automobile which includes a barrel-like extinguisher body, fire-extinguishing substances contained in the extinguisher body, a push-button type switch disposed on the top end of the extinguisher body, a spray-opening formed in the extinguisher body, and a safety lock mounted on the extinguisher body so as to prevent the fire-extinguishing substances from being accidentally sprayed from the spray-opening. When the safety lock is removed from the extinguisher body and the switch is depressed, the fire-extinguishing substances can be expelled from the spray-opening. The extinguisher is characterized by a mounting seat fixed in the driver cab in proximity to the driver's seat so as to connect removably with the extinguisher body, a resilient element disposed removably on the extinguisher body so as to depress the switch, a hose extending from the cab to the engine compartment, an adapter disposed on the extinguisher body intercommunicating one end of the hose and the spray-opening, and a nozzle disposed on the other end of the hose in the engine compartment and directed to the engine. When the safety lock is removed from the extinguisher body, the fire-extinguishing substances are sprayed onto the engine.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
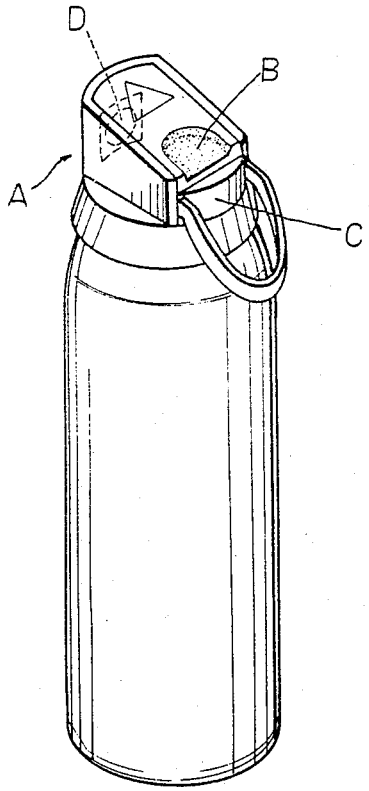
FIG. 1 PRIOR ART
FIG. 1 is a perspective view of a conventional extinguisher for use in an automobile.
Figure 2:
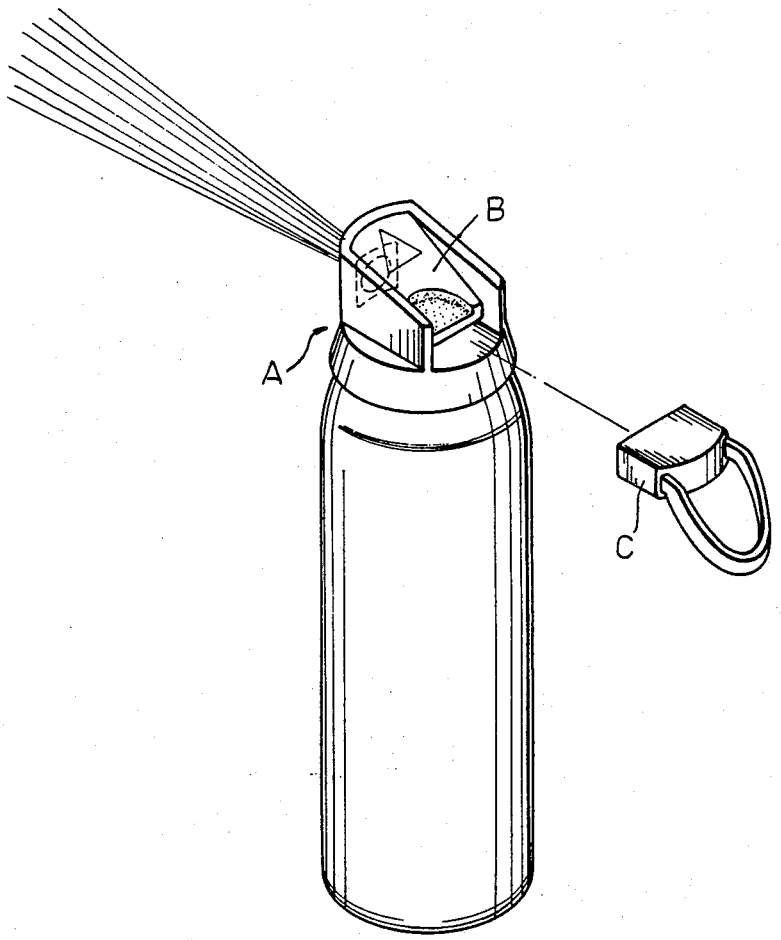
FIG. 2 PRIOR ART
FIG. 2 is a schematic view illustrating the operation of the conventional extinguisher.
Figure 3:
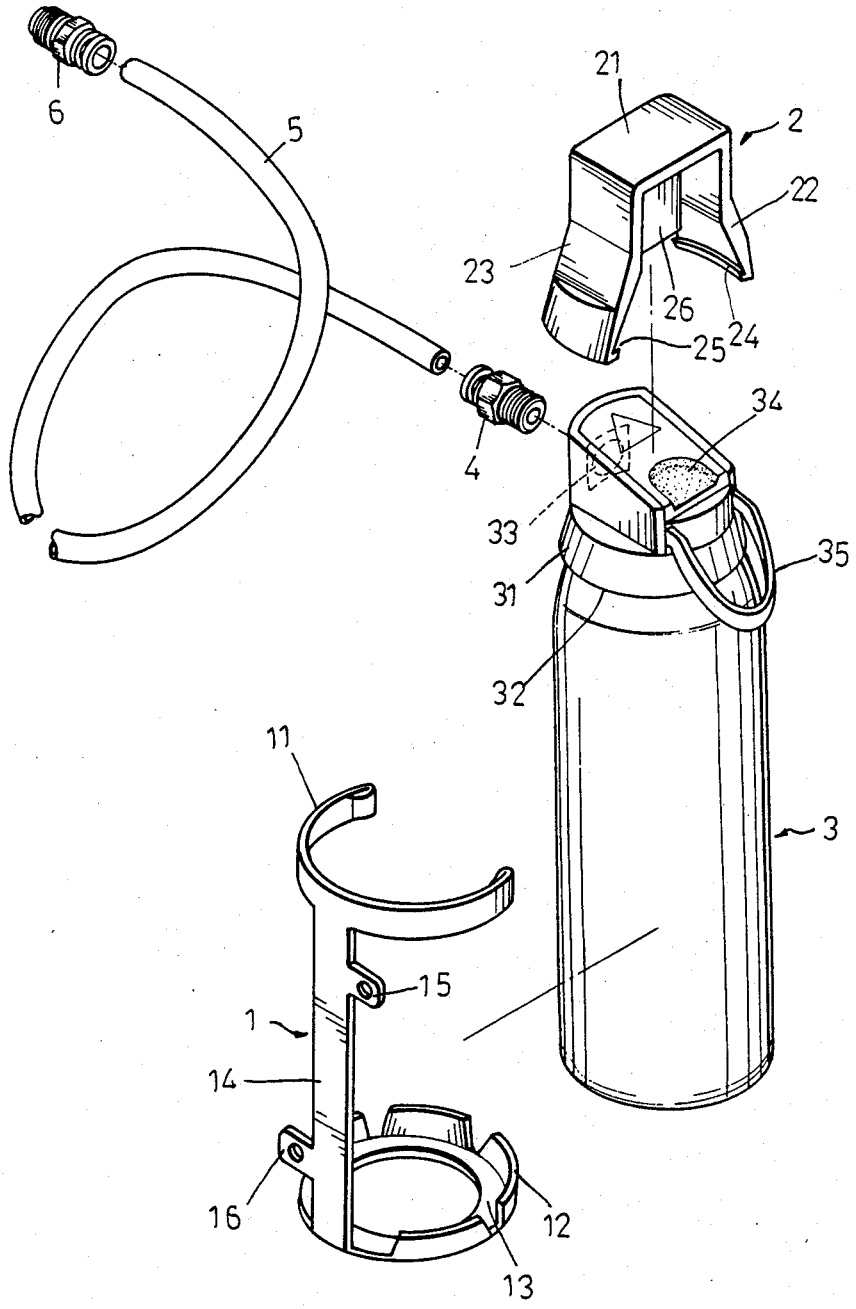
FIG. 3 is an exploded view of an extinguisher for use in an automobile according to this invention.
Figure 4:
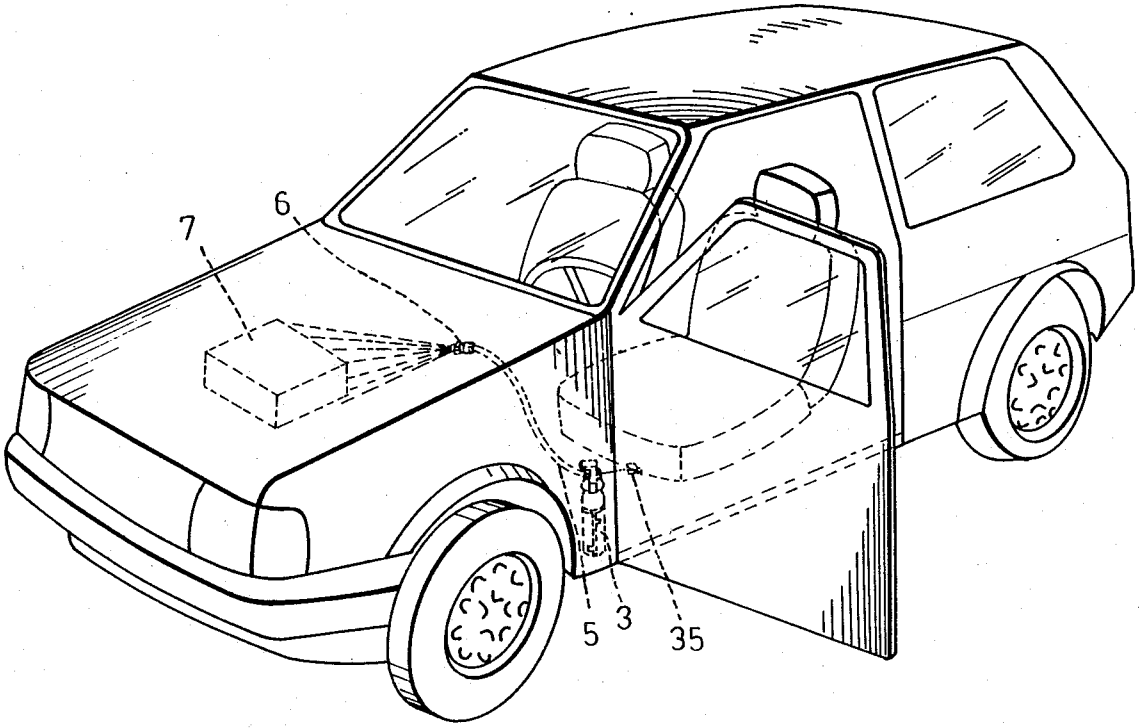
FIG. 4 is a schematic view illustrating the position of the extinguisher in the automobile according to this invention.
Figure 5:
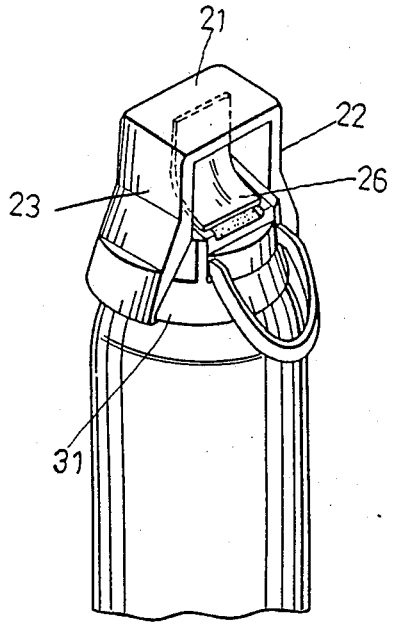
FIG. 5 is a perspective view showing the upper end portion of the extinguisher according to this invention.

Referring to FIGS. 3-5, an extinguisher of this invention is used in an automobile and includes a metal mounting seat 1, a metal pressing member 2, a barrel-like extinguisher body 3, an adapter 4, a hose 5 and a nozzle 6.

The mounting seat 1 includes a vertical strip 14 having two lugs 15, 16 integrally formed with two sides thereof, a supporting ring 13 integrally formed with the lower end of the strip 14 so as to place the extinguisher body 3 thereon, and a C-shaped hoop 11 integrally formed with the upper end of the strip 14 at the middle portion thereof so as to hold the upper portion of the extinguisher body 3 thereon. Each of the lugs 15, 16 has a hole formed therethrough whereby the mounting seat 1 can be fixed, by means of screws, in the driver's cab of the automobile body near the driver's seat. The supporting ring 13 includes several circumferential projections 12 extending upward therefrom which enclose the bottom end of the extinguisher body 3.

The extinguisher body 3 is constructed in a known manner and includes a skirt-like upper portion 31, a spray-opening 33, a push-button type switch 34 and a safety lock 35. The pressing member 2 includes a horizontal plate 21 and two hooks 22, 23, extending generally downward from two ends of the plate 21. The hooks 22, 23 have curved lower ends 24, 25 for resiliently engaging the lower hem 32 of the skirt-like portion 31. A spring reed 26 extends downward from the plate 21 to press against the switch 34. The hooks 22, 23 may be pulled outward to remove the pressing member 2 from the extinguisher body 3. As illustrated, because the inner surfaces of the hooks 22, 23 have flattened upper portions which abut against the flattened upright walls of the extinguisher body 2, the pressing member 2 can be easily fixed on the extinguisher body 3.

The adapter 4 is sleeved tightly on one end of the hose 5 and is engaged threadably with the extinguisher body 3 so as to intercommunicate the hose 5 and the spray-opening 33 of the extinguisher body 3. The hose 5 extends from the driver's cab to the engine compartment of the automobile. The nozzle 6 is sleeved tightly on the other end of the hose 5 and is directed to the engine 7.

When the automobile is involved in a traffic accident causing the engine 7 to catch fire, the driver, while sitting in the driver's seat, can pull the safety lock 35 away from the extinguisher body 3 so as to instantly spray the fire-extinguishing substances in the extinguisher body 3 from the nozzle 6.

With this invention thus explained, it is apparent that numerous modifications and variations can be made without departing from the scope and spirit of this invention. It is therefore intended that this invention be limited only as indicated in the appended claims.

I claim:

1. An extinguisher for use in an automobile including a body having a driver's compartment and an engine compartment, an engine disposed in the engine compartment, and a driver's seat disposed in the driver's compartment, said extinguisher including a barrel-like extinguisher body containing fire-extinguishing substances under pressure, a spray opening on an upper end of the extinguisher body, a hose having one end connected to the spray opening and another end located in the engine compartment, a spray nozzle connected to the other end of the hose, a push valve interposed between the interior of the extinguisher body and the spray opening for delivering the fire extinguishing substances from the interior of the extinguisher through the spray opening and the hose to the nozzle in response to an actuating force, an actuating device having a movable member biased for movement toward the push valve for applying an actuating force to open the valve, a removable safety lock mounted between the movable member and the push valve to prevent accidental actuation of the push valve, and means for mounting the extinguisher in the automobile body in a location such that the safety lock can be removed by a person in the driver's seat to permit actuation of the push valve, wherein said extinguisher body includes a skirt-like upper end portion and the actuating device comprises a pressing member connected rearwardly to said skirt-like portion, said pressing member being made of metal and including two generally downward extending hooks having curved lower ends for resiliently engaging a lower end of said skirt-like portion, and said movable member being a spring reed extending downward from said pressing member to press against said push valve so as to open said valve, and wherein said hooks can be pulled outward to remove said pressing member from said extinguisher body.

* * * * *